United States Patent [19]

Ueshima et al.

[11] Patent Number: 4,738,301

[45] Date of Patent: Apr. 19, 1988

[54] METHOD FOR MITIGATING SOLIDIFICATION SEGREGATION OF STEEL

[75] Inventors: Yoshiyuki Ueshima; Tooru Matsumiya; Shozo Mizoguchi, all of Kawasaki, Japan

[73] Assignee: Nippon Steel Corporation, Tokyo, Japan

[21] Appl. No.: 892,475

[22] Filed: Aug. 5, 1986

Related U.S. Application Data

[63] Continuation-in-part of Ser. No. 700,675, Feb. 11, 1985, abandoned.

[30] Foreign Application Priority Data

Feb. 10, 1984 [JP] Japan ..... 59-21940
Feb. 10, 1984 [JP] Japan ..... 59-21941
Feb. 10, 1984 [JP] Japan ..... 59-21942

[51] Int. Cl.[4] ..... B22D 11/22

[52] U.S. Cl. ..... 164/455; 164/486; 164/122; 148/3

[58] Field of Search ..... 164/486, 487, 444, 122, 164/455; 148/2, 3

[56] References Cited

U.S. PATENT DOCUMENTS 3,771,584 11/1973 Wojcik ..... 164/486 X

FOREIGN PATENT DOCUMENTS 52-77816 6/1977 Japan ..... 164/122
54-4224 1/1979 Japan ..... 164/122
261660 12/1977 U.S.S.R. ..... 164/444

*Primary Examiner*—Koang Y. Lin
*Attorney, Agent, or Firm*—Wenderoth, Lind & Ponack

[57] ABSTRACT

The $\alpha$-stabilizing element, e.g. P, and the $\gamma$-stabilizing element, e.g. Mn, do not segregate at an identical site of a casting. Castings are cooled at a rate of 40° C./min or less in a temperature range of the peritectic reaction and/or the $Ar_4$ transformation, thereby condensing P and Mn into $\delta$ and $\gamma$ phases, respectively.

14 Claims, 7 Drawing Sheets

METHOD FOR MITIGATING SOLIDIFICATION SEGREGATION OF STEEL

This application is a continuation-in-part, of now abandoned application Ser. No. 700,675, filed Feb. 11, 1985, now abandoned.

BACKGROUND OF THE INVENTION

1. Field of the Invention

The present invention relates to a method for mitigating the solidification segregation of a casting produced by the continuous casting method and a cast ingot produced by the ingot-making method. Such segregation causes surface flaws, cracks, and other material defects in the final steel product.

2. Description of the Related Art

The segregation of solutes during continuous casting results in formation of surface flaws and cracks of the casting, thereby impairing the qualities of the final product. Mitigation of the solidification segregation has therefore been desired. Known methods for mitigating the segregation include: adding calcium into the molten steel; preliminarily decreasing, by refining of the molten steel, the amount of solute elements which cause detrimental segregation; and lessening the roll-distance of a continuous casting machine to suppress the bulging of a casting and electromagnetically stirring the melt to mitigate the central segregation.

It is known that, when a casting is hot-rolled without once cooling down to normal temperature after its solidification, considerable hot-embrittlement occurs during the hot-rolling and, therefore, surface flaws frequently form. In one conventional practice, therefore, ingots cast at the ingot-making yard or castings produced by the continuous casting machine are allowed to cool down to room temperature and then are preliminarily reheated in a reheating furnace or are allowed to cool down to room temperature, cleared of surface flaws, then charged into a heating furnace to be heated to the rolling temperature and then hot-rolled (c.f. for example, "Iron and Steel Handbook" Third Edition, edited by Japan Institute for Iron and Steel III (1) pp 120–143, especially pp 140–141, and pp 207–212). In any case, by the reheating and heating described above, elements which segregate in the casting or the like and result in cracks and flaws can be uniformly distributed. The heat treatment necessary for uniformly distributing the elements, however, takes a disadvantageously long time of from 2 to 10 hours and involves temperatures of from 1200° C. to 1300° C.

From the viewpoints of saving energy and labor, however, either direct rolling or hot-charge rolling is preferable.

In direct rolling, the casting is not allowed to cool down to room temperature, but is rolled directly after the continuous casting. In hot-charge rolling, the casting is charged in a heating furnace before cooling to room temperature and is then rolled.

Japanese Unexamined Patent Publication (Kokai) No. 55-84203 proposes a method for suppressing the surface cracks in direct rolling and hot-charge rolling. The method proposed by this publication involves subjecting the casting, after its melting and solidification (the primary cooling), to ultraslow cooling during a secondary cooling stage until the initiation of the hot-rolling.

This publication threw light, by a simulation experiment, on a particular temperature range of from 1300° C. to 900° C. wherein elements, such as phosphorus, sulfur, oxygen, and nitrogen, detrimental to the hot-workability of steels, segregate and precipitate as non-metallic inclusions, and drew attention to the fact that surface cracks frequently occur when the percentage of reduction in area of steel materials becomes less than 60%. The method proposed in this publication controls the morphology of the above-mentioned elements precipitated as non-metallic inclusions so as to suppress the hot-cracking of castings.

Japanese Unexamined Patent Publication No. 55-109503 and No. 55-110724 also disclose slowly cooling the continuous castings prior to the hot-rolling and directly rolling them.

Japanese Examined Patent Publication (Kokoku) No. 49-6974 discloses a cooling and heating treatment of a continuously cast strand in which the temperature difference between the surface and central liquid of the castings is kept from becoming excessively great.

Japanese Unexamined Patent Publication No. 54-4224 discloses a method for enhancing the toughness of steels by cooling, during the casting of steels.

In this method, the cooling at a rate of 80° C./min or more at a temperature range directly before the initiation of $\delta \rightarrow \gamma$ transformation down to the single $\gamma$-phase temperature is allegedly effective for enhancing the toughness. It is, however, difficult to lessen the central segregation by such rapid cooling. The patent publication discloses that, in the conventional castings of a continuous casting, the cooling rate is from 15° to 40° C./minute in a temperature range of from 1450° C. to 1200° C. The part of the casting to which the cooling rate corresponds is not specifically shown in the patent publication but is construed, from general knowledge, to be that at the $\frac{1}{4}$ thickness of the casting. In addition, the above cooling rate is construed to be an estimated value based on a calculation of the heat transfer.

The cooling rate at the $\frac{1}{2}$ thickness of a casting, where the segregation is serious, is greater than that at the $\frac{1}{4}$ thickness, at a time directly after the completion of solidification. For example, as shown in the Iron and Steel Handbook, 3rd Edition, Vol. 2, p 621, FIG. 12, 21 (edited by The Iron and Steel Institute of Japan), the cooling rate at the $\frac{1}{2}$ thickness of a casting is 60° C./min in a temperature range from 1480° to 1400° C. This cooling rate at the $\frac{1}{2}$ thickness of blooms and billets with a small cross-section is considerably greater than the 15 to 40° C./min mentioned above.

It is impossible in such rapid cooling to mitigate central segregation by utilizing solid-state diffusion after solidification and $\delta \rightarrow \gamma$ transformation.

SUMMARY OF THE INVENTION

The present inventors noticed that the qualities of castings are not merely impaired by the quantity of solidification segregation but are also detrimentally influenced synergistically by duplicate segregation, in which both $\alpha$-stabilizing elements (P, Si, S, Cr, Nb, V, Mo, or the like) and $\gamma$-stabilizing elements (C, Mn, Ni, or the like) condense at an identical site. The present inventors also noticed that the solubilities of $\alpha$-stabilizing elements in each of the $\delta$ and $\gamma$ phases differed from those of the $\gamma$-stabilizing elements.

The present inventors then discovered that the solutes are effectively separated from one another at a particular temperature range. This temperature range is either different from the prior art temperatures described above or was not disclosed in the prior art.

According to the present invention, there is provided a method for mitigating the solidification segregation of steel, characterized in that a casting or cast ingot of the steel is cooled at a rate of 40° C./minute or less in a temperature range where a δ phase and γ phase coexist in the casting or cast ingot, thereby separating α-stabilizing elements and γ-stabilizing elements from one another by means of an $Ar_4$ transformation alone or both a peritectic reaction and an $Ar_4$ transformation, which occur during the cooling.

An object of the present invention is to lessen the central segregation of a casting, as will be apparent hereinabove. Accordingly, the cooling rate referred to hereinafter indicated that at the ½ thickness of a casting.

DESCRIPTION OF THE PREFERRED EMBODIMENTS

The principle of the present invention will first be described with reference to FIG. 1.

Figure 1:
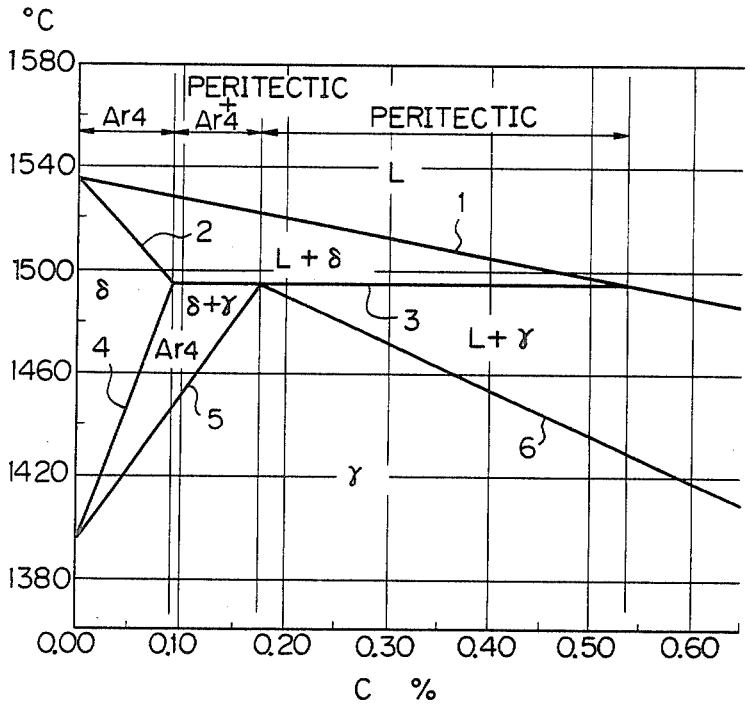
FIG. 1 is a phase diagram of carbon steel, for illustrating the cooling of a casting.
Figure 2A:
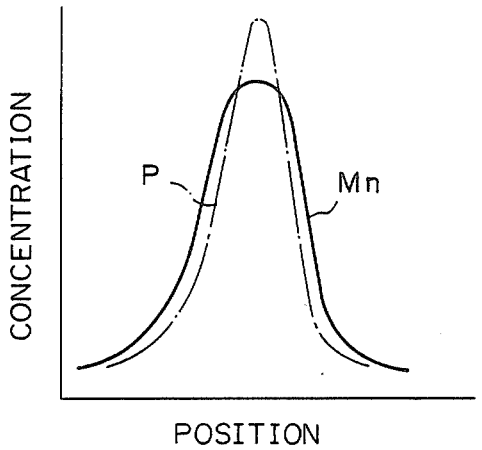
FIGS. 2(A) and 2(B) illustrate the separation of solutes.
Figure 2B:
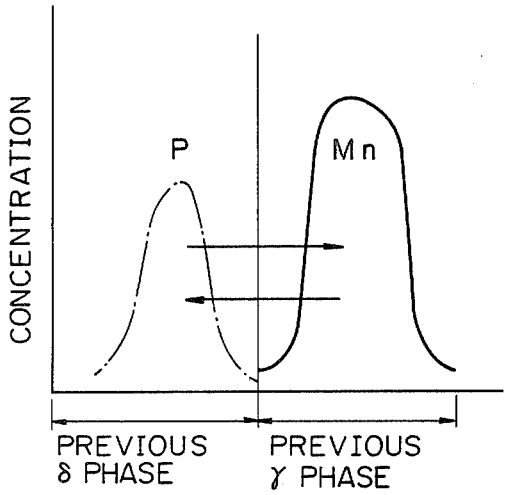

FIG. 1 is a phase diagram of low-carbon steel, for illustrating the cooling of a casting. When the carbon concentration is in the range of from 0.005% to 0.17%, there is always a temperature region when the δ phase and γ phase coexist. In the steels, α-stabilizing elements such as P, Si, S, Cr, Nb, V, and Mo, and γ-stabilizing elements such as Mn and Ni are contained as impurities or additive elements and when duplicate segregation of α- and γ-stabilizing elements, especially P and Mn, occurs, the segregation particularly and seriously influences the qualities of the casting. Since the solubilities of Mn and P in each of the γ and δ phases are different from one another, heat treatment at a temperature region where the γ and δ phases coexist, makes it possible to separate the Mn and P from one another, as shown in FIGS. 2(A) and 2(B). FIGS. 2(A) and 2(B) show the Mn and P-concentrations before and after the heat treatment, respectively.

In order to separate the α- and γ-stabilizing elements from one another in the casting, steel is slow-cooled at a rate of 40° C./minutes or less in the time period where an $Ar_4$ transformation or a peritectic reaction, and/or $Ar_4$ transformation occurs. That is, the above described transformation and reaction induced during cooling directly after casting or during cooling after heating of the casting are utilized to separate the α-stabilizing elements and γ-stabilizing elements from one another. The solidification segregation of a casting or ingot is thus mitigated. Preferably, a casting or cast ingot is then cooled at a rate of 30° C./min or more when the temperature of a casting or ingot is lowered to less than the $Ar_4$ transformation point or the temperature range where the phase changes due to the $Ar_4$ transformation occurs. In this preferred cooling, slow cooling at the γ-phase region is avoided, since the elements which are separated on purpose again uniformly distribute due to diffusion under the slow cooling.

Instead of slowly cooling just once at a cooling rate of 40° C./min or less in a temperature region where the δ and γ phases coexist, a repeated heating and cooling operation may be carried out. This operation is equally effective for separating the α- and γ-stabilizing elements as slow cooling, provided that heating and cooling are repeated within the α-and 65 -phase coexistent temperature region or a temperature between this region and the γ-phase region and further that the heating rate is higher than the cooling rate. A casting is preferably heated at a rate greater than the secondary cooling rate of continuous casting. Preferably, the temperature is held for a predetermined time, for example at least 3 minutes, at the δ- and γ-phase coexistent temperature region. When the temperature is lowered from this region down to the γ-phase region, the cooling is preferably carried out at a rate as rapid as possible.

Referring again to FIG. 1, steel having a carbon concentration of between 0.017% and 0.53% undergoes, during the cooling, a change from the liquid (L) phase (region above the curve 1) to the liquid (L) phase plus the δ phase, and, a change from the liquid (L) phase plus the δ phase to the liquid (L) phase plus the γ phase at 1495° C. (line 3). When the cooling further proceeds, the steel becomes entirely the γ phase at a temperature below the line 6.

Steel having a carbon concentration of from 0.005% to 0.08% undergoes, during cooling, successive transformations from the liquid (L) phase, liquid (L) phase plus δ phase, δ phase, and γ phase. The transformation from the δ phase to the γ phase is referred to as the $Ar_4$ transformation. The $Ar_4$ transformation begins at the straight line 4 and continues until the straight line 5. By utilizing the coexistence of the δ and γ phases during the phase changes of the $Ar_4$ transformation between the straight lines 4 and 5, the α- and γ-stabilizing elements are collected into the δ phase and γ phase, respectively, in accordance with the solubility difference and are separated once from one another. For example, P and Mn move into the δ and γ phases, respectively, once. When the $Ar_4$ transformation advances further to an extent that the entire steel changes to the γ phase, the α-stabilizing elements are collected in or segregated in a part of the γ phase last transformed from the δ phase. As a result, the segregation sites which exhibit the P concentration-peak are separated from those exhibiting the Mn concentration-peak.

When steel has a carbon concentration of from 0.08% to 0.17%, both the peritectic reaction and Ar4 transformation can be utilized for separating the α- and γ-stabilizing elements from one another.

By utilizing the peritectic reaction, in which change of the liquid (L) phase and the δ phase into the liquid (L) phase and γ phase occurs at a transformation temperature at 1495° C. and at the interface between the liquid and δ phases, α-stabilizing elements such as P, Si, S, and Cr, especially P and S, are collected in the δ phase, i.e., the untransformed δ phase, at a transformation temperature of 1495° C., while γ-stabilizing elements such as, C, Mn, Ni, especially Mn, are collected in the $\gamma$ phase. When all the phases become $\gamma$ as a result of further cooling, the $\alpha$-stabilizing elements are collected or segregated in a part of the $\gamma$ phase last transformed from the $\delta$ phase. As a result, the segregation sites which exhibit the P concentration peak are separated from those exhibiting the Mn concentration peak therefore duplicate segregation of P and Mn is avoided.

Figure 3:
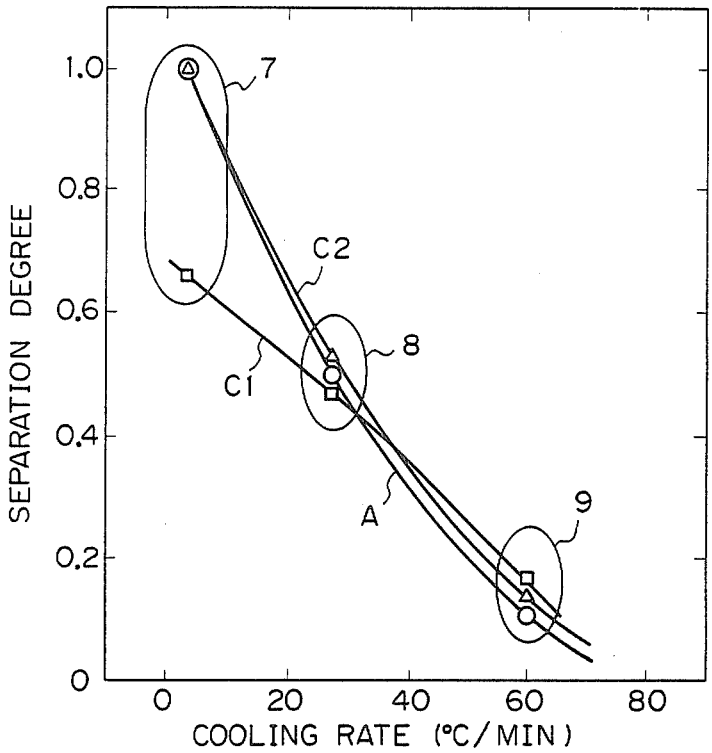
FIG. 3 is a graph showing the relationships between the cooling speed of a casting and the separation degree.

Referring to FIG. 3, the relationships between the separation degrees and the time required for the phase changes, i.e., the cooling speed in a practical operation, are shown. In FIG. 3, "7" denotes a cooling speed of 2.7° C./minute, "8" a cooling speed of 40° C./minute, and "9" a cooling speed of presently used continuous casting machines at the center of a cast section i.e. a half thickness part of the cast section.

As is apparent from FIG. 3, slow cooling at a rate of 40° C./minute or less results in a separation degree twice as high as the one attained by presently used continuous casting machines. The following three indices are used for the separation degree.

Concentration-separation degree $C_1$ $$= \left(\frac{Mn^*/Mn^\circ}{P^*/P^\circ}\right) \Big/ \left(\frac{K_{Mn}^{\gamma/L}/K_{mn}^{\delta/L}}{K_p^{\gamma/L}/K_P^{\delta/L}}\right)$$

$$= \left(\frac{Mn^*/Mn^\circ}{P^*/P^\circ}\right)/1.80$$

Concentration separation degree $C_2$ $$= \left(\frac{P^*/P^\circ}{Mn^*/Mn^\circ}\right) \Big/ \frac{K_P^{\delta/L}/K_P^{\gamma/L}}{K_{Mn}^{\delta/L}/K_{Mn}^{\gamma/L}}$$

$$= \left(\frac{P^*/P^\circ}{Mn^*/Mn^\circ}\right)/1.80$$

Area separation degree $A$ $$= 1 - \frac{\text{Overlapping area ratios of high } Mn \text{ Concentration sites and high } P \text{ concentration sites}}{\text{Area ratio of high } Mn \text{ concentration sites}}$$

Mn* and P* indicate the Mn and P concentrations, respectively, in the part of the $\gamma$ phase transformed at the beginning of transformation from the $\delta$ phase, in the case of the concentration-separation degree $C_1$, and in the part of the $\gamma$ phase transformed at the end of transformation from the $\delta$ phase, in the case of the concentration-separation degree $C_2$. Mn° and P° are the average concentrations of Mn and P, respectively. $K_i^{a/b}$ indicates an equilibrium partition coefficient of the component, which is partitioned between the phase "a" and phase "b". As equilibrium partition coefficients of Mn and P, the values given in Table 1 are used. In the area separation degree, 5% is used for each of the area ratios of high Mn and P concentration.

| | $K^{\delta/L}$ | $K^{\gamma/L}$ |
|---|---|---|
| Mn | 0.77 | 0.784 |
| P | 0.23 | 0.13 |

Again referring to FIG. 3, 50 kg/mm$_2$ steels (0.13% C) were continuously cast while varying the cooling rate at a temperature range of from 1500° C. to 1450° C. and then rapidly cooled at a rate of 4500° C./min at a temperature lower than 1450° C. If the cooling rate during the phase change or transformation is too high as in conventional secondary cooling, duplicate segregation cannot be expected to be prevented, since there is not sufficient time for the solute elements to separate. The lowest cooling rate can be determined by process economy. When separation of the $\alpha$- and $\gamma$-stabilizing elements by the phase change and transformation is completed, a single solid phase is formed, so that separation of the $\alpha$- and $\gamma$-stabilizing elements due to the solubility difference does not occur. The $\alpha$- and -stabilizing elements separated on purpose tend to uniformly distribute again, unless the temperature of the single solid phase is rapidly decreased. The rate of cooling after the separation treatment should be 30° C./minute or more according to various researches by the present inventors.

The separation efficiency utilizing the peritectic reaction and $Ar_4$ transformation is enhanced by repeating the slow cooling procedure. After the temperature is once lowered to a level less than the temperature region of the peritectic reaction and $Ar_4$ transformation, the steel is rapidly heated to elevate the temperature up to the temperature region mentioned above, and the slow cooling in the temperature range of peritectic reaction and $Ar_4$ transformation is resumed. The rapid heating and slow-cooling may be again carried out.

After the repeated slow cooling procedure, cooling at a rate of 30° C./minute or more is carried out to prevent the separated $\alpha$- and $\gamma$-stabilizing elements from being again uniformly distributed in the single solid phase. An example of the repeated slow cooling is described hereinbelow in Example 3.

In order to implement the method according to the present invention, a heating device controlling the cooling rate of a casting is installed at such a part of the secondary cooling zone of a continuous casting machine that the temperature of the $\delta$-phase and liquid-phase interface and the temperature of the $\delta$-phase boundaries in a part of the casting, which part enters the heating device, are not yet lowered to the peritectic temperature and the $Ar_4$ transformation temperature, respectively, and, further, that the casting leaves the heating device at a temperature less than the one at which the transformation of all or a major part of the phase into the $\gamma$ phase is completed. A casting is heated by the heating device to attain the cooling rate of 40° C./minute or less to promote mutual separation of the solutes and to control the surface temperature of a casting at a half of the thickness of the casting, so as to complete the transformation of all or a major part of the $\delta$ phase into the $\gamma$ phase at the outlet of the heating device. The extent of the $\gamma$-phase transformation at the outlet of the heating device can be determined by the economy of heating by the heating device in relation to the cooling capacity of a continuous casting machine downstream of the heating device. The surface-temperature control mentioned above allows practical control of the ratio of solidification within a casting and a casting structure.

The internal structure of a casting varies depending upon the carbon concentration of steel but can be virtually determined by the temperature. That is, the peritectic reaction or $Ar_4$ transformation begins at approximately 1500° C. and ends at approximately 1400° C. The heating device can therefore be installed near the part of the casting where the temperature ranges from approximately 1500° C. to 1400° C.

In addition, it is the segregation occurring in the neighborhood of a central part of the continuously cast strands that mainly results in the quality failure of castings and final products. From the viewpoint of improving the quality described above, the temperature of castings should be controlled so that a casting having the solidification degree of 85% or more, particularly 95% or more is cooled at a rate of 40° C./minute or less, since the central segregation is liable to occur at the center of castings solidifying at the solidification degree of 85% or more. In this case, the solidification degree is used as a supplementary standard for determining the installation point of the heating device.

Figure 4:
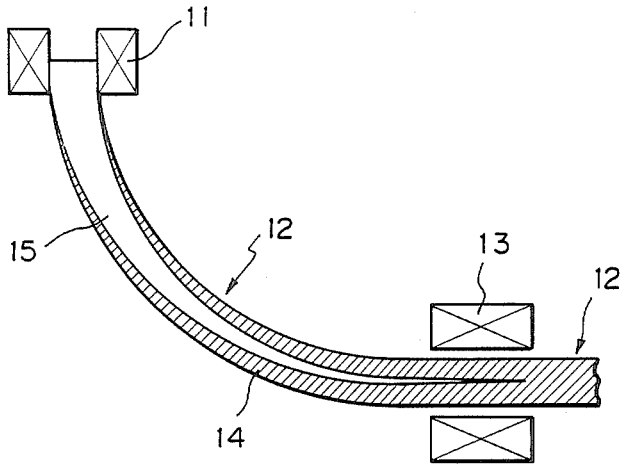
FIG. 4 is an illustrative drawing of a continuous casting machine provided with a heating device, according to the present invention.

Referring to FIG. 4, a mold 11 is primarily cooled by water. Reference numeral 12 indicates the secondary cooling zone, in which cooling is carried out with sprayed water. A heating device 13 is installed at a part of the casting where the solidification is virtually completed. The hatched portion 14 indicates the solidified part of the casting. The unsolidified part of the casting is denoted by 15. The heating method may be induction heating, electric conduction heating, gas heating, plasma heating, high frequency heating, or the like.

In addition to the heating device 13, a conventional soaking device can also be used for treating cast ingots or cut castings. Induction heating, electric conduction heating, gas heating, plasma heating, high frequency heating, or the like may be used as the soaking means.

EXAMPLE 1

Figure 5:
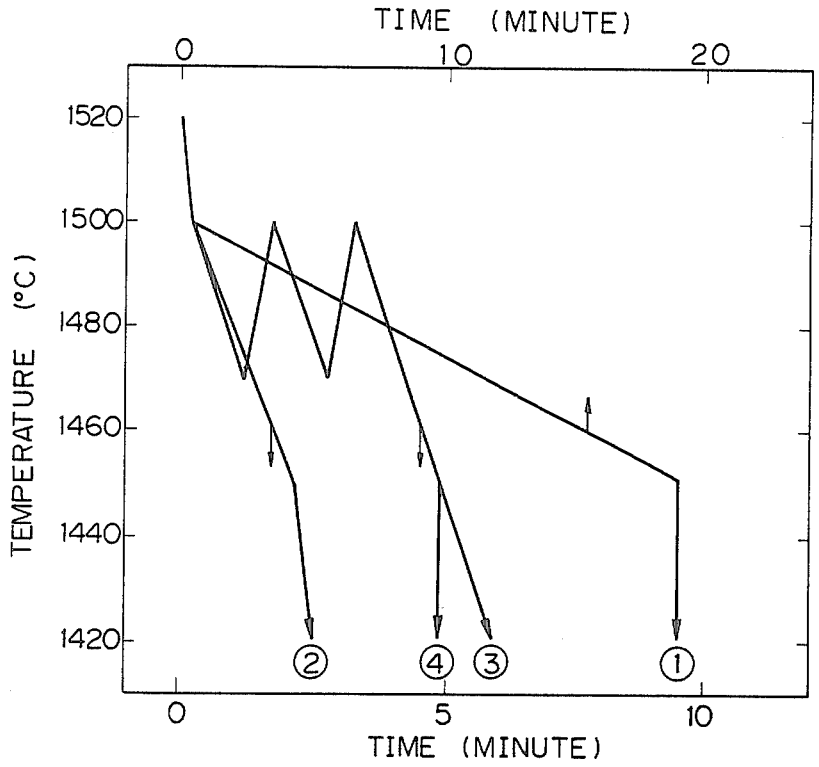
FIG. 5 graphically illustrates the heat history in an example.

Steel (carbon concentration of 0.13%) having a tensile strength of 50 kg/mm$^2$ was cooled down to 1450° C. at a rate of 2.7° C./min and subsequently cooled down to room temperature at a rate of 4500° C./min (the heat cycle is shown by 1 by in FIG. 5). The separation degrees of P and Mn were measured at the central segregation part of the steel. The separation degrees in terms of the concentration-separation degrees $C_l$ and $C_2$ and the area-separation degree were 0.67, 1.00, and 1.00, respectively.

Figure 6A:
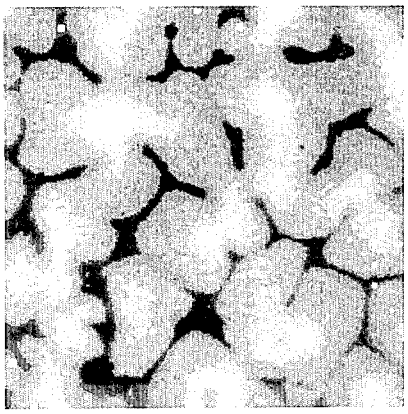
FIGS. 6(A), 6(B), and 6(C) are photographs showing the distribution of Mn, Si, and P, respectively, in the steel structure.
Figure 6B:
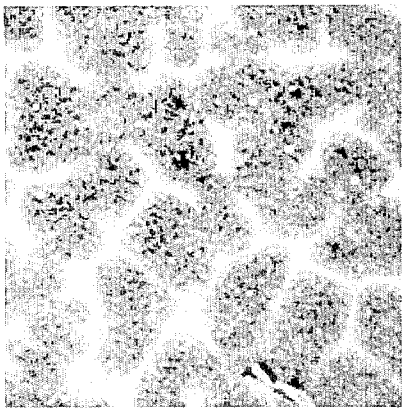
Figure 6C:
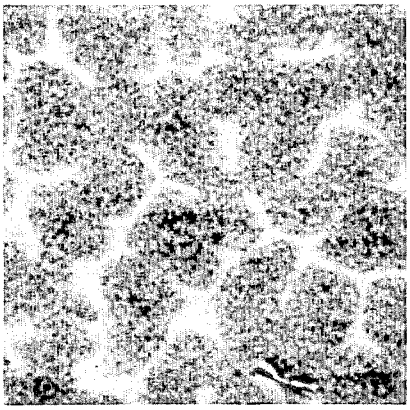

The solidification structure of Mn, Si, and P was measured by a two-dimensional electron probe microanalyzer (EPMA) analysis to obtain the characteristic X-ray image of the solidification structure. The characteristic X-ray image was processed to indicate the concentration differences in the five stages and is shown in FIGS. 6(A), 6(B), and 6(C). The 14 mm length of the photographs corresponds to a length of 200 μm. In FIG. 6(A), an Mn concentration of from 1.4% to 1.6% is shown by five-stage shading. In FIG. 6(B), an Si concentration of from 0.03% to 0.04% is shown by five-stage shading. In FIG. 6(C), a P concentration of from 0.006% to 0.021% is shown by shading of five stages. In FIGS. 6(A) through 6(C), the concentration of Mn, Si, and P is high in the parts which appear white. The parts where Si and P highly concentrate overlap one another, but are clearly separated from the parts where Mn highly concentrates.

Figure 7A:
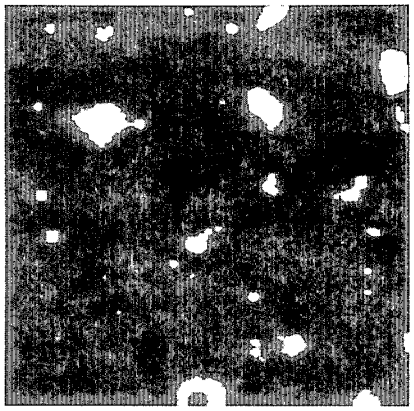
FIGS. 7(A) and 7(B) are photographs showing distribution of high-concentration areas having 5% of Mn and 5% of P, respectively, in the steel structure.
Figure 7B:
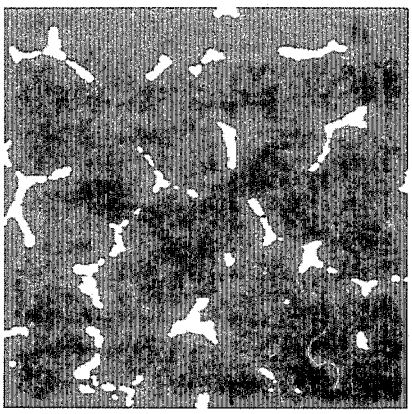

FIGS. 7(A) and 7(B) show, by white colored parts, the areas where Mn and P are highly concentrated, i.e. 5%, respectively. The 14 mm length of FIGS. 7(A) and 7(B) corresponds to 200 mm. As is also apparent from FIGS. 7(A) and 7(B), Mn and P are clearly separated from one another.

EXAMPLE 2

The same steel as in Example 1 was cooled at a rate of 27° C./minute from 1500° C. to 1450° C. (the heat history is shown by 1 of FIG. 5). The separation degrees of Mn and P were measured at the segregation part of the steel. The separation degrees in terms of the concentration-separation degrees $C_1$ and $C_2$ and the area-separation degree were 0.41, 0.40, and 0.38, respectively.

EXAMPLE 3

A casting having a carbon concentration of 0.30% was cooled at a cooling rate of 30° C./min from 1500° C. to 1470° C., heated at a rate of 60° C./min up to 1500° C., and subsequently cooled again by the above cooling. The heating and cooling were repeated once. The heat history is shown by 3 of FIG. 5. The separation degrees in terms of concentration-separation degrees $C_l$ and $C_2$ and the area-separation degree A were 0.32, 0.30, and 0.28, respectively.

EXAMPLE

The same procedure as in Example 3 was repeated. Then, cooling down to room temperature was carried out at a cooling rate of 4500° C./min. The heat history is shown by 4 of FIG. 5.

The separation degrees in terms of the concentration-separation degrees $C_l$ and $C_2$ and the area-separation degree A were 0.40, 0.42, and 0.38, repectively.

The controlled cooling according to the present invention was carried out in a continuous casting.

A high-frequency heating device 4 m in length was installed in the secondary cooling zone of the continuous casting machine at a position where the central temperature of a casting (carbon concentration of 0.13%) was decreased to 1490° C., i.e., a position 12 m downstream of the meniscus. The casting was withdrawn at a speed of 1.0 m/minute and maintained at a surface temperature of approximately 1000° C. at the entrance of the heating device. The surface temperature of the casting was elevated by the heating device up to 1400° C. The cooling rate of the casting was decreased to approximately 20° C./min. The solidification ratios of casting were 85% and 100% at the entrance and outlet of the heating device.

The Mn and P concentrations of the casting continuously cast under the above-described conditions were measured at the central segregation part thereof along the longitudinal direction by means of two-dimensional EPMA analysis. The separation degrees of P and Mn at the central segregation part in terms of the concentration-separation degrees $C_1$ and $C_2$ and the area-separation degree A were 0.48, 0.52, and 0.50, respectively.

For comparison purpose, continuous casting was carried out under the above-described conditions except that the heating device was not installed. In this case, the cooling rate of the casting at its central portion was approximately 60° C./min in the temperature range of from 1490° C. to approximately 1000° C. The separation degrees of P and Mn at the central segregation part in terms of $C_l$, $C_2$ and A were 0.15, 0.10, and 0.08, respectively. This comparative casting clearly shows that the heating device as installed above effectively enhances the separation of P and Mn.

EXAMPLE 5

Low carbon steel containing 0.10% of C was cast into a casting by a conventional continuous casting machine.

In order to separate Mn and P from one another at the central segregation part of the casting, it was cooled, after temperature elevation up to 1480° C., down to 1450° C. at a rate of 10° C./minute and then rapidly cooled down to normal temperature at a rate of 50° C./minute. The two-dimensional EPMA analysis of P and Mn was carried out and the separation degrees were then calculated.

The P and Mn separation degrees in the neighborhood of the center of the casting were 0.56, 0.74, and 0.80, in terms of $C_l$, $C_2$, and A, respectively.

For comparison purpose, low carbon steel containing 0.10% of carbon was continuously cast by a conventional manner and then soaked at 1250° C. for 8 hours. The P and Mn separation degrees in the neighborhood of central segregation of the casting were 0.48, 0.58, and 0.52, respectively, in terms of $C_1$, $C_2$, and A.

We claim:

1. A method for mitigating a solidification segregation of steel during a continuous casting of steel or ingot casting of steel which contains α-phase stabilizing elements and γ-phase stabilizing elements other than carbon and further contains carbon from 0.005% to 0.08% inducing an $Ar_4$ transformation, comprising the steps of:

cooling said casting in a first temperature range where liquid and δ phases are present and where all of the α-phase stabilizing elements and the γ-phase stabilizing elements have the highest concentrations at interdendritic liquid regions essentially coincident with one another;

further cooling said casting from the first temperature range down to a second temperature range where the δ phase and a γ phase coexist in a solidified shell of the casting;

controlling a cooling rate of the region in the casting which corresponds to approximately half of the thickness of the casting and where the δ phase and the γ phase coexist in the second temperature range to 40° C./min or less thereby separating the α-phase stabilizing elements and γ-phase stabilizing elements from one another at said region in said casting;

further cooling said casting from the second temperature range down to a third temperature range where the δ phase disappears and only the γ phase exists at said region in the solidified shell; and performing cooling in the third temperature range, while retaining separated α-phase stabilizing elements and γ-phase stabilizing elements, the highest concentration sites of the elements being separated due to the controlled cooling rate.

2. A method according to claim 1, wherein the casting is cooled at a rate of 30° C./minute or more at said region in the casting when the $Ar_4$ transformation is completed.

3. A method according to claim 2, wherein heating and cooling of the casting is repeated at least once while the temperature of the casting is within a temperature range of the $Ar_4$ transformation and the rate of the heating is made higher than the rate of the cooling.

4. A method according to claim 1, wherein heating and cooling of the casting is repeated at least once while the temperature of the casting is within a temperature range of the $Ar_4$ transformation and the rate of the heating is made higher than the rate of the cooling.

5. A method according to claim 1, wherein said casting is produced by continuous casting, and said cooling at a rate of 40° C./minute or less is carried out during a secondary cooling of the continuous casting.

6. A method according to claim 1, wherein said casting is cooled below the temperature at which the $Ar_4$ transformation is completed and is then heated to a temperature where the γ phase and δ phase coexist, and, thereafter said cooling at a rate of 40° C./minute or less is conducted.

7. A method according to claim 6, wherein after heating to the temperature where the δ phase and γ phase coexist, said casting is maintained at this temperature for a predetermined time.

8. A method for mitigating a solidification segregation of steel during a continuous casting of steel or ingot casting of steel which contains α-phase stabilizing elements and γ-phase stabilizing elements other than carbon and further contains carbon more than 0.08% to 0.17% inducing an $Ar_4$ transformation and a peritectic reaction, comprising the steps of:

cooling said casting in a first temperature range where liquid and δ phases are present and where all of the α-phase stabilizing elements and the γ-phase stabilizing elements have the highest concentrations at interdendritic liquid regions essentially coincident with one another;

further cooling said casting from the first temperature range down to a second temperature range where the peritectic reaction is induced and then the δ phase and a γ phase coexist at the region corresponding to approximately half the thickness of the casting;

controlling a cooling rate of said region in the casting where the δ phase and the γ phase coexist in the second temperature range to 40° C./min or less thereby separating the α-phase stabilizing elements and γ-phase stabilizing elements from one another at said region in said casting;

further cooling said casting from the second temperature range down to a third temperature range where the δ phase disappears and only the γ phase exists at said region in a solidified shell; and performing cooling in the third temperature range, while retaining separated α-phase stabilizing elements and γ-phase stabilizing elements, the highest concentration sites of the elements being separated due to the controlled cooling rate.

9. A method according to claim 8, wherein the casting is cooled at a rate of 30° C./minute or more at said region in the casting when the peritectic reaction or $Ar_4$ transformation is completed.

10. A method according to claim 9, wherein heating and cooling of the casting is repeated at least once while the temperature of the casting is within a temperature range of the peritectic reaction and the $Ar_4$ transformation and the rate of the heating is made higher than the rate of the cooling.

11. A method according to claim 8, wherein heating and cooling of the casting is repeated at least once while the temperature of the casting is within a temperature range of the peritectic reaction and the $Ar_4$ transformation and the rate of the heating is made higher than the rate of the cooling.

12. A method according to claim 8, wherein said casting is produced by continuous casting, and said cooling at a rate of 40° C./minute or less is carried out during a secondary cooling of the continuous casting.

13. A method according to claim 8, wherein said casting is cooled below the temperature at which the Ar4 transformation is completed and is then heated to a temperature where the $\gamma$ phase and $\delta$ phase coexist, and, thereafter said cooling at a rate of 40° C./minute or less is conducted.

14. A method according to claim 13, wherein after heating to the temperature where the $\delta$ phase and $\gamma$ phase coexist, said casting is maintained at this temperature for a predetermined time.

* * * * *